United States Patent [19]

Richter

[11] 3,947,229

[45] Mar. 30, 1976

[54] GAS BURNER

[76] Inventor: Enrique Kusminsky Richter, J. E. Uribury 262, Buenos Aires, Argentina

[22] Filed: Jan. 31, 1975

[21] Appl. No.: 546,171

[52] U.S. Cl. ..... 431/125; 126/92 R; 431/328

[51] Int. Cl.[2] ..... F24L 3/04

[58] Field of Search..... 431/125, 328; 126/92 R, 126/127

[56] References Cited

UNITED STATES PATENTS

| | | | |
|---|---|---|---|
| 948,561 | 2/1910 | Hamsen | 431/125 |
| 3,324,924 | 6/1967 | Hailstone et al. | 431/328 |
| 3,583,845 | 6/1971 | Pulone | 431/125 |
| 3,671,175 | 6/1972 | Campbell | 126/92 R |
| 3,751,213 | 8/1973 | Sowards | 431/328 |

*Primary Examiner*—Edward G. Favors

*Attorney, Agent, or Firm*—Sughrue, Rothwell, Mion, Zinn & Macpeak

[57] ABSTRACT

An unvented, open-flame type room heater comprising an open-faced container having a chamber therewithin, a plate mounted in the chamber so as to divide it into an upper and a lower volume and having a myriad of tiny passageways therein leading from the lower volume to the upper volume, means for introducing gas and air into the lower volume, a plurality of bars spanning the open face of the container in parallel, spaced array, and a plurality of simulated logs located on top of the bars in generally parallel relationship thereto.

6 Claims, 2 Drawing Figures

GAS BURNER

BACKGROUND OF THE INVENTION

1. Field of the Invention

This invention relates to unvented, open-flame type room heaters employing simulated logs. Such room heaters are commonly installed in real or simulated fireplaces, and they have decorative as well as heat-generating functions.

2. Description of the Prior Art

Room heaters of the above type commonly employ so called "infra-red" plates covered by a metal lattice which assists in the diffusion of the flames. However, it is difficult to disguise or hide such metal lattices, the visibility of which detracts from the desired natural effect of the simulated logs. Moreover, such metal lattices prevent the flames from emerging from between the logs, which also detracts from the desired natural effect. However, if the metal lattices were simply removed from the prior art room heaters of this type, the result was loss of efficiency and the production of excessive amounts of toxic waste gasses such as carbon monoxide, unless appropriate supplementary ventilation was also installed.

OBJECT OF THE INVENTION

Accordingly, it is the object of this invention to provide a room heater of the unvented, open-flame type which simulates a true log burning fireplace with a high degree of accuracy, does not produce excessive amounts of toxic waste gasses, has a high level of efficiency, and does not require supplementary ventilation.

SUMMARY OF THE INVENTION

This invention consists of an unvented, open-flame type room heater comprising an open-faced container having a chamber therewithin, a plate mounted in the chamber so as to divide it into an upper and a lower volume and having a myriad of tiny passageways therein leading from the lower volume to the upper volume, means for introducing gas and air into the lower volume, a plurality of bars spanning the open face of the container in parallel, spaced array, and a plurality of simulated logs located on top of the bars in generally parallel relationship thereto.

DETAILED DESCRIPTION OF A PREFERRED EMBODIMENT

Figure 1:
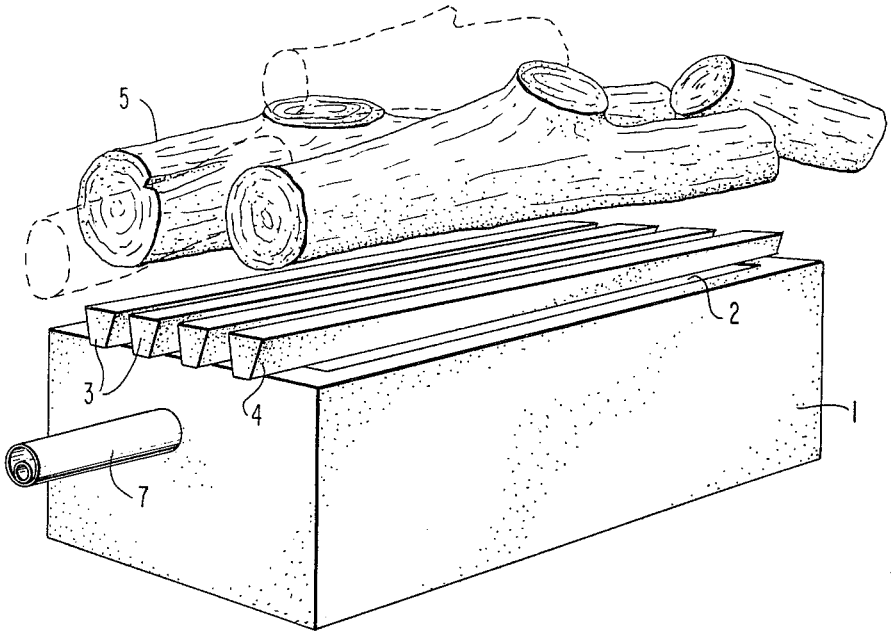
FIG. 1 is a perspective view of a gas burner according to the present invention.
Figure 2:
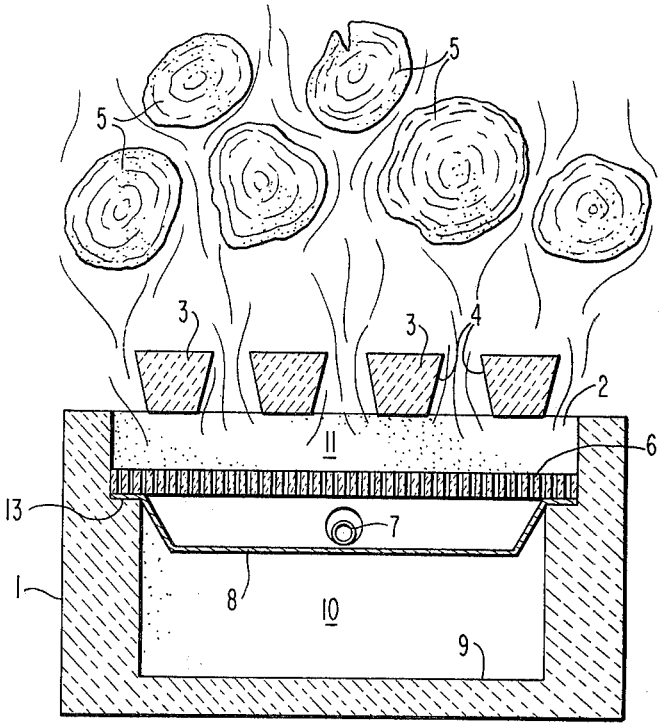
FIG. 2 is a cross-sectional view of the gas burner shown in FIG. 1.

The preferred embodiment of this invention shown in the drawings comprises a container 1, a plate 6, means 7 for introducing gas and air into the lower volume 10 contained within the container 1, a plurality of bars 3, and a plurality of simulated logs 5.

The container 1 is made of a refractory material, such as refractory ceramic, has a chamber therewithin, and has an open face 2 on the top thereof. The container 1 is preferably, though not necessarily, rectangular parallelopipedal in shape.

The plate 6 is also made of a refractory material, such as refractory ceramic, and it is mounted in the container 1 so as to divide the chamber therewithin into an upper volume 11 and a lower volume 10. The lower volume 10 can be entirely empty or, as shown, means defining a separate interior chamber 8 can be disposed therewithin. The purpose of mounting the plate 6 interiorly of the container 1 is to shield it from exposure to ambient temperature variations and drafts which would otherwise alter the normal caloric flow of the device. The plate 6 contains a myriad of tiny passageways 12 more or less evenly distributed over the major faces of the plate and leading from the lower volume 10 to the upper volume 11. Each passageway must be large enough in cross section to readily pass a mixture of comburent gas and air but otherwise the passageways should be as small and as closely spaced as is economically feasible. As shown, the plate 6 may be simply laid on an appropriate circumferential shelf 13 in the container 1.

The means 7 for introducing gas and air into the lower volume 10 preferably, though not necessarily, comprise two tubes leading into the lower volume 10, one of the two tubes being located within the other.

The plurality of bars 3 are made of a refractory material and span the open face 2 of the container 1 in parallel, spaced array. They are shaped such that the sides 4 of their longitudinal cross sections converge towards the chamber within the container 1. The purpose of this is to cause flames and unburn gas to circulate in the converging spaces between the bars 3, providing a combustion zone which is separate and distinct from the combustion zone in upper volume 11. Conveniently, their cross sections have the shape of a regular trapezoid the minor base of which is towards the plate 6. Also conveniently, the plurality of bars 3 are held in fixed mutual relationship by means not shown, but they are simply laid on the top of the container 1.

The plurality of simulated logs 5 are located on top of the plurality of bars 3 in generally parallel relationship thereto. Portions of the exteriors of adjacent logs 5 are in contact, but passageways are left therebetween. These passageways serve as a third separate and distinct combustion zone. Preferably, but not necessarily, the simulated logs are made out of refractory material, such as refractory ceramic. Conveniently, the plurality of bars 5 are held in fixed mutual relationship by means not shown.

When the heater is being used, gas and air passes into the lower volume 10 (or, more particularly in the embodiment shown, into the interior chamber 8), where they are mixed (if they have not already been mixed externally of the device) and allowed to spread out more or less homogeneously beneath the plate 6. The mixture of gas and air then passes through the myriad of tiny passageways 12 in the plate 6 and enters the upper volume 11. In the upper volume 11, the mixture of gas and air is initially burned. However, not all the gas is burned in that volume, and the burning continues in the space between adjacent bars 3 and in the passageways between adjacent logs 5. The plate 6, the bars 3, and the logs 5 soon become red hot, and tests (described hereinafter) have shown that combustion of the gas by the time it emerges from the logs 5 is virtually complete—or, at any rate, so nearly complete that the level of toxic waste products emitted is far below accepted levels.

Test Results of Embodiments of this Invention

Three models of commercial embodiments of this invention, all of which were within the scope of claim 1 of this application, were submitted to the State Gas Company of Argentina for testing. All three tests were successful, the results being summarized below.

Test No. 1, Model 80

This test was conducted in a room having a volume of $30^3$ meters. Both natural and liquid gas were used, and the results for each are given in parallel columns below.

| | Natural Gas | Liquid Gas |
|---|---|---|
| Length of Test | 2¼ hours | 2¼ hours |
| Temperature of the Room at the Beginning of the Test | 23°C. | 22°C. |
| Temperature of the Room at the End of the Test | 43°C. | 44°C. |
| Consumption of Gas | 715 liters/hour | 308 liters/hour |
| Percentage of $CO_2$ Emitted at End of Test | 0.9% | 1.2% |
| Percentage of $O_2$ Emitted at End of Test | 18.2% | 18.0% |
| Percentage of CO Emitted at End of Test | 0.005% | 0.008% |

Test No. 2, Model 74

The size of the test room is not given in the official report, but it was probably the same room as was used for the first test. Again, both natural and liquid gas were used.

| | Natural Gas | Liquid Gas |
|---|---|---|
| Length of Test | 3¼ hours | 4¾ hours |
| Temperature of the Room at the Beginning of the Test | 26°C. | 24°C. |
| Temperature of the Room at the End of the Test | 44°C. | 38°C. |
| Consumption of Gas | 489.7 liters/hour | 141.6 liters/hour |
| Percentage of $CO_2$ Emitted at End of Test | 0.4% | 0.6% |
| Percentage of $O_2$ Emitted at End of Test | 19.8% | 19.8% |
| Percentage of CO Emitted at End of Test | 0.000% | 0.005% |

Test No. 3, Model 76

Again, the size of the test room is not given in the official report, and again both natural and liquid gas were used.

| | Natural Gas | Liquid Gas |
|---|---|---|
| Length of Test | 3¼ hours | 4¾ hours |
| Temperature of the Room at Beginning of the Test | (not given) | (not given) |
| Temperature of the Room at the End of the Test | 44°C. | 38°C. |
| Consumption of Gas | 489.7 liters/hour | 141/6 liters/hour |
| Percentage of $CO_2$ Emitted at End of the Test | 0.4% | 0.6% |
| Percentage of $O_2$ Emitted at the End of the Test | 19.8% | 19.8% |
| Percentage of CO Emitted | 0.000% | 0.005% |

-continued

| | Natural Gas | Liquid Gas |
|---|---|---|
| at the End of the Test | | |

Caveat

While the present invention has been illustrated by a detailed description of a preferred embodiment thereof, it will be obvious to those skilled in the art that various changes in form and detail can be made therein without departing from the true scope of the invention. For that reason, the invention must be measured by the claims appended hereto and not by the foregoing preferred embodiment.

What is claimed is:

1. An unvented, open-flame type room heater comprising:

a. a container
  i. made of a refractory material,
  ii. having a chamber therewithin, and
  iii. having an open face on the top thereof;

b. a plate
  i. made of a refractory material,
  ii. mounted in said container so as to divide the chamber therewithin into upper and lower volumes, and
  iii. having a myriad of tiny passageways therein leading from the lower volume to the upper volume;

c. means for introducing gas and air into the lower volume;

d. a plurality of bars
  i. made of refractory material,
  ii. spanning the open face of said container in parallel, spaced array, and
  iii. shaped such that the sides of their longitudinal cross sections converge towards the chamber in said container; and e. a plurality of simulated logs
  i. located on top of said plurality of bars in generally parallel relationship thereto and
  ii. in contact with adjacent logs along portions of their exteriors, but leaving passageways therebetween, whereby, when the heater is being used, the gas and air passes through the myriad of tiny passageways in said plate and is burned in three separate locations, namely, between said plate and said plurality of bars, in the spaces between adjacent ones of said plurality of bars, and in the passageways between adjacent ones of said plurality of simulated logs, thereby virtually eliminating the passage of carbon monoxide into the surrounding atmosphere.

2. A room heater as recited in claim 1 wherein said container is a rectangular parallelopiped in shape.

3. A room heater as recited in claim 1 wherein said means for introducing gas and air into the lower volume comprise two tubes leading into the lower volume.

4. A room heater as recited in claim 3 wherein one of said tubes is located within the other.

5. A room heater as recited in claim 1 wherein the cross sections of said bars have the shape of a regular trapezoid the minor base of which is towards said plate.

6. A room heater as recited in claim 1 wherein said simulated logs are made out of a refractory ceramic material.

* * * * *